United States Patent [19]

Bissinger

[11] Patent Number: 4,696,717

[45] Date of Patent: Sep. 29, 1987

[54] PROCESS FOR AUTOMATICALLY REGENERATING COPPER CHLORIDE ETCH SOLUTIONS

[75] Inventor: Werner D. Bissinger, Sindelfingen, Fed. Rep. of Germany

[73] Assignee: International Business Machines Corporation, Armonk, N.Y.

[21] Appl. No.: 787,560

[22] Filed: Oct. 15, 1985

[30] Foreign Application Priority Data

Oct. 19, 1984 [EP] European Pat. Off. ..... 84112630.3

[51] Int. Cl.[4] ..... C23F 1/46

[52] U.S. Cl. ..... 156/642; 156/666; 156/345; 134/10

[58] Field of Search ..... 156/642, 345, 666; 134/10

[56] References Cited

U.S. PATENT DOCUMENTS

| | | | |
|---|---|---|---|
| 3,306,792 | 2/1967 | Thürmel et al. | 156/642 |
| 3,880,685 | 4/1975 | Rehm et al. | 156/642 |
| 4,388,276 | 6/1983 | Konstantouros et al. | 422/187 |

FOREIGN PATENT DOCUMENTS

| | | | |
|---|---|---|---|
| 2942504 | 4/1981 | Fed. Rep. of Germany . | |
| 53-103942 | 9/1978 | Japan | 156/642 |
| 55-152180 | 11/1980 | Japan | 156/642 |

*Primary Examiner*—S. Leon Bashore
*Assistant Examiner*—Andrew J. Anderson
*Attorney, Agent, or Firm*—Mark Levy; Max Kenemore

[57] ABSTRACT

The invention concerns a process for automatically regenerating copper chloride etch solutions, wherein regeneration is effected by means of hydrogen peroxide and hydrochloric acid in a regeneration unit separated from the etch chamber. The addition of hydrogen peroxide is controlled by a redox electrode, while hydrochloric acid and water are added in computed quantities. Hydrogen peroxide and hydrochloric acid are converted in an oxidation reactor into hypochlorous acid and immediately afterwards are combined with the copper (I) chloride etch solution which contains at least the quantity of hydrochloric acid required for oxidizing the copper (I) ions. In the regeneration unit a salt basket with solid sodium chloride is arranged or adjacent to said unit a salt tank with an overflow to said regeneration unit is provided, both of which permit the sodium chloride concentration of the etch solution being kept constant. The invention also comprises a system for automatically regenerating copper chloride etch solutions.

16 Claims, 4 Drawing Figures

REACTION SEQUENCE IN OXIDATION REACTOR

PROCESS FOR AUTOMATICALLY REGENERATING COPPER CHLORIDE ETCH SOLUTIONS

BACKGROUND OF THE INVENTION

1. Field of the Invention

The invention concerns a process for automatically regenerating copper chloride etch solutions, wherein the etchant is withdrawn from the etch chamber and regenerated in a separate regeneration unit by means of hydrogen peroxide and hydrochloric acid, diluted with water and then fed back to the etch chamber.

2. Description of the Related Art

It is known that printed circuits may be produced by etching copper and/or copper alloy coated insulation boards with a hydrochloric copper(II) chloride solution. The disadvantage of using a copper chloride solution as an etchant is, however, that such a solution becomes rapidly exhausted and has to be continually regenerated to ensure acceptable etching times. The copper(I) chloride formed when copper is etched with copper(II) chloride according to the equation $$CuCl_2 + Cu \rightarrow 2\ CuCl$$

must be reoxidized to copper(II) chloride in the regeneration phase by adding a suitable oxidizing agent The oxidizing agents used most frequently are compressed air, which is applied through frits at the base of a stationary tank (DE-C No. 12 07 183), or chlorine gas (U.S. Pat. No. 3,083,129 and DE-C No. 16 21 437), or sodium chlorate (DE-C No. 12 25 465), or hydrogen peroxide and hydrochloric acid (DE-C No. 18 07 414 and Z. Elektronik, 1969, Vol. 11, pages 335 and 336, "Moderne Aetzverfahren fuer Druckschaltungen").

In the latter process, the aqueous solutions of hydrogen peroxide and hydrochloric acid are added within the etch system by measuring the redox potential. If there are changes in potential, the solutions are added according to DE-C No. 18 07 414 such that the first valve controlling the flow of hydrochloric acid is definitely opened before the second valve controlling the $H_2O_2$ flow and definitely closed after the $H_2O_2$ valve, thus ensuring that there is always an excess quantity of HCl in the solution. Put simply, during regeneration by means of the above-described oxidizing agents the following reactions occur:

Air: $2\ CuCl + 2\ HCl + \frac{1}{2}\ O_2 \rightarrow 2\ CuCl_2 + H_2O$

Chlorination: $2\ CuCl + Cl_2 \rightarrow 2\ CuCl_2$

Chlorate: $6\ CuCl + NaClO_3 + 6\ HCl \rightarrow 6\ CuCl_2 + 3\ H_2O + NaCl$

Peroxide: $2\ CuCl + H_2O_2 + 2\ HCl \rightarrow 2\ CuCl_2 + 2\ H_2O$

According to DE-C No. 20 08 766, the exhausted etch solution may also be regenerated by means of an oxygen containing gas and by recovering the etched copper by electrolysis. Of the previously described regeneration processes, the peroxide process has so far been the most favorable for cost reasons and because of its high reaction rate and yield.

From DE-A No. 2 942 504 an etch solution containing copper(II) chloride for etching copper on circuit boards is known which in lieu of hydrochloric acid uses an alkali chloride, in particular potassium chloride, as a complexing agent. According to DE-A No. 2 942 504, the etch solution is regenerated in a simple manner by introducing air. Although this process is suitable for use on a laboratory scale, the very low reaction rate and the high air volumes needed for regeneration render it uneconomical for large-scale technical applications involving, say, >1000 boards a day. Another disadvantage is that air oxidation requires that the copper(II) hydroxide thus formed, from which copper in a metallic form may be obtained by dissolution in acid and subsequent electrolysis, be filtered. This process cannot be implemented in a closed cycle, since the copper occurring as copper hydroxide is difficult to filter from the etch solution.

SUMMARY OF THE INVENTION

Proceeding from the above-described prior art, it is the object of the invention to provide a process for regenerating exhausted copper chloride etch solutions, which can be implemented continuously and fully automatically and whose effectiveness is 100 per cent. The regeneration process according to the invention uses hydrogen peroxide and hydrochloric acid for regeneration, with the hydrochloric acid being used at low concentration and the missing chloride ions being provided by adding sodium chloride and maintaining a constant sodium chloride concentration in the etchant.

The object according to the invention is accomplished by a regeneration process which is characterized in that in an oxidation reactor a quantity of hydrogen peroxide corresponding to the copper(I) ion concentration to be regenerated is converted by means of the stoichiometric quantity of hydrochloric acid into hypochlorous acid and, while the hypochlorous acid is formed, it decomposes immediately to form active oxygen which combines with the etch solution to be regenerated which contains at least the quantity of hydrochloric acid required for oxidizing the copper(I) ions and sodium chloride as a complexing agent.

The invention also concerns a regeneration system for automatically regenerating copper chloride etch solutions.

The foregoing and other objects, features and advantages of the invention will be apparent from the following more particular description of preferred embodiments of the invention, as illustrated in the accompanying drawings.

BRIEF DESCRIPTION OF THE DRAWINGS

The process according to the invention, by means of which the copper(II) chloride etch solution that has become enriched with copper(I) ions during the etching of copper may be continuously regenerated, will be explained in detail below with reference to FIGS. 1 to 4 and the special description, in which.

DESCRIPTION OF THE PREFERRED EMBODIMENTS

For the process according to the invention, etching and regeneration are effected in separate systems, with the etch solution being continuously circulated at high speed between both systems. The volume of the regeneration tank is much greater than that of the etch system, so that, if necessary, several etch systems may be connected to the same regeneration unit.

Figure 1:
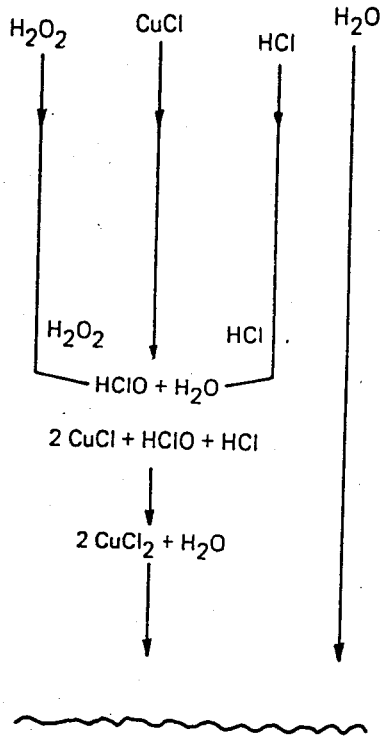
FIG. 1 shows the chemical reactions occurring during the regeneration of copper(I) chloride in the oxidation reactor.

During the etching of copper(II) chloride, copper(I) chloride is obtained according to the equation $Cu + CuCl_2 \rightarrow 2\ CuCl$, which is practically insoluble in the etch bath and, as a result of an inhibiting film formed on the surface of the copper to be etched, noticeably reduces the etch rate of the etch solution even at low concentration. Therefore, it is desirable to minimize the quantity of copper(I) chloride occurring during etching and/or to rapidly reoxidize the copper(I) chloride to copper(II) chloride. Although the copper(I) chloride may be kept in a dissolved state as a complex with chloride ions—the latter being obtained according to the art by the content of concentrated hydrochloric acid in the etch solution exceeding 200 ml/l—such highly hydrochloric solutions have the disadvantage of reducing the life of the etch and regeneration systems and adversely affecting the quality of the etched conductor image by underetching, which is unacceptable for conductor widths of less than 100 μm, as are currently required. Therefore, according to the invention, the content of hydrochloric acid in the copper chloride etch solution is to be reduced to values of less than about 30 ml $HCl_{conc.}$/l, and the missing chloride is to be added in the form of sodium chloride. This enhances the etch rates of the etch solutions much more noticeably than the previously mentioned high content of hydrochloric acid. At a high content of sodium chloride, the etch solution, as a result of the strong bonding of the monovalent copper in the form of the $[CuCl_2]$ complex, is capable of accommodating a much greater amount of $Cu^{1+}$ than would be possible at a high hydrochloric acid concentration of the solutions. An etch solution with a sodium chloride content of about 3 mol/l, for example, still yields satisfactory etch results at a copper(I) content of about 20 g/l. That the content of hydrochloric acid of the etch solutions cannot be reduced to zero in the process according to the invention, as is described, for instance, in DE-A No. 29 42 504, is attributable to the fact that instead of the regeneration process by the introduction of air described in that application, the present process uses hydrogen peroxide which by means of the stoichiometrically required quantity of HCl has to be converted into the actually effective hypochlorous acid and water (FIG. 1). As previously explained, the latter process, when used on a large technical scale, is much more effective than regeneration by the introduction of air.

Previously (DE-C No. 18 07 414), the hydrogen peroxide required for regenerating the etch solution was added directly. For that purpose, a high hydrochloric acid concentration of the etch solution was indispensable, since at a low hydrochloric acid concentration the $H_2O_2$ immediately decomposes under the catalytic influence of the copper(II) ions according to the equation:

$$2\ H_2O_2 \xrightarrow[\text{catalyst}]{Cu^{2+}\text{as}} 2\ H_2O + 188\ kJoule$$

To prevent this catalytic decomposition, the invention provides for the $H_2O_2$, immediately before being added to the etch solution to be regenerated, to react with the minimum quantity of hydrochloric acid needed for reaction according to the equation $$H_2O_2 + HCl \rightarrow HClO + H_2O.$$

The hypochlorous acid, which is highly unstable, causes the copper(I) chloride immediately after its formation in the oxidation reactor to be oxidized practically 100 percent to copper(II) chloride according to the reaction equation $$2\ CuCl + HClO + HCl \rightarrow 2\ CuCl_2 + H_2O.$$

Figure 3:
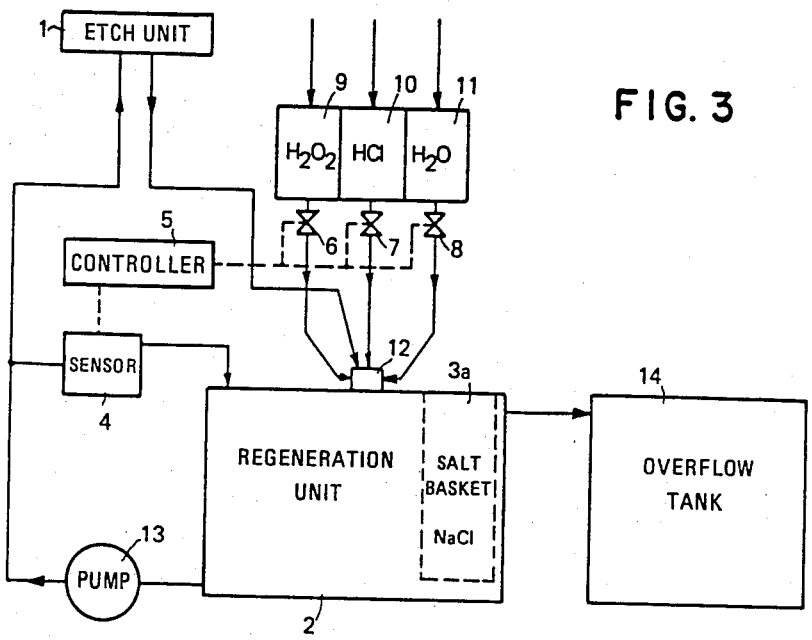
FIG. 3 shows a regeneration unit to which sodium chloride is added on the "salt basket principle"
Figure 4:
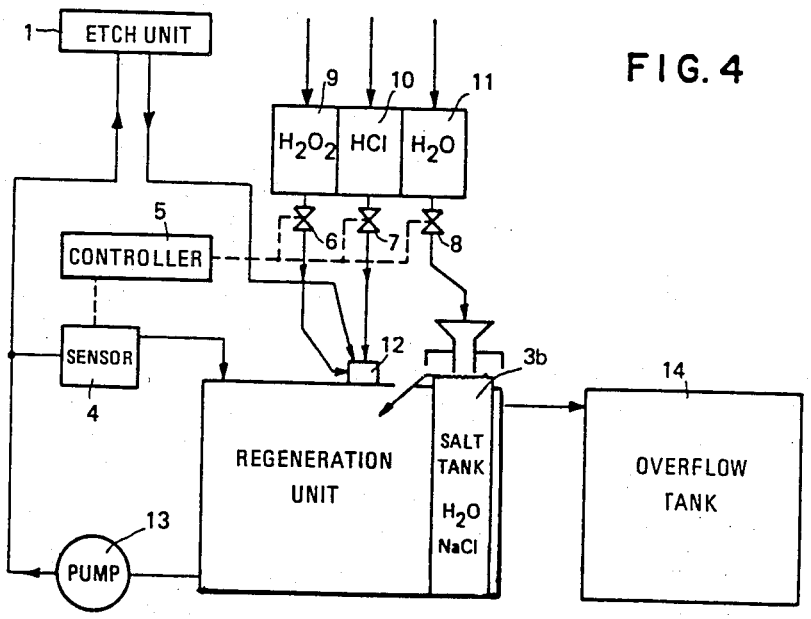
FIG. 4 shows a regeneration unit to which sodium chloride is added on the "salt tank principle".

The water needed to dilute the etch solution to the desired concentration is fed through a separate line to the regeneration unit (FIG. 3) or to the salt tank (FIG. 4).

Figure 2:
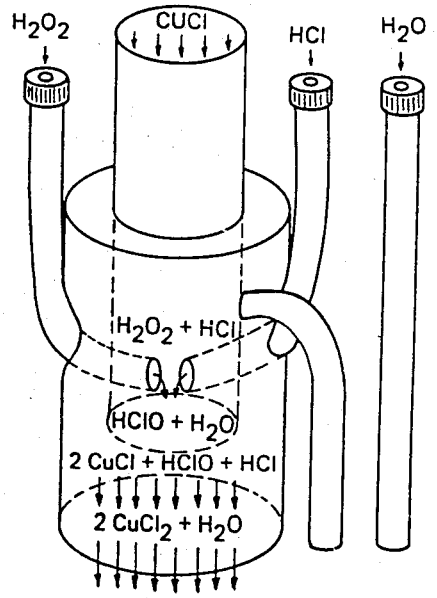
FIG. 2 shows an embodiment of the oxidation reactor.

In FIG. 1 the chemical reactions occurring during oxidation are represented by means of formulas. FIG. 2 shows an oxidation reactor in which the reactions according to FIG. 1 take place. The etch solution containing copper(I) chloride flows through the central tube. Through the lateral lines, hydrogen peroxide and hydrochloric acid are added such that shortly before combining with the etch solution to be regenerated they react to form hypochlorous acid and water. In the etch solution, as shown by the formulas in the lower portion of the oxidation reactor, two molecules of copper(I) chloride then react with one molecule of the hypochlorous acid and one molecule of hydrochloric acid, yielding two molecules of copper(II) chloride and water. Through the line shown on the outside on the right-hand side, water is added, in order to continually maintain the desired concentration of copper(II) ions in the etch solution.

After $H_2O_2$, HCl and the etch solution to be regenerated have combined, the etch solution is provided to drop freely until it enters the regeneration unit 2. It is also advantageous to provide for a stop, not shown, to be positioned between the storage tank 9 for $H_2O_2$ and the oxidation reactor 12. In lieu of the described oxidation reactor it is also possible to use a static mixer for having $H_2O_2$ react with HCL and for oxidizing the copper(I) chloride with HClO.

Automatic control of the above-described oxidation of copper(I) ions to copper(II) ions is a prerequisite for a continuous process.

The most favorable concentrations of the bath components for etching copper with copper(II) chloride solutions have been determined by tests.

| | mol/l | g/l |
|---|---|---|
| $Cu^{2+}$ | 1.5 | 95 g/l Cu° = 256 g/l $CuCl_2 \cdot 2\ H_2O$ |
| $Cu^{1+}$ | 0.063–0.095 | 4–6 |
| HCl | 0.10 | 3.6 = 10 ml/l 32 percent HCl |
| NaCl | 3.6 | 215 (salt tank) |
| NaCl | 4.0 | 240 (salt basket) |

temperature T: 45–55° C.

The $Cu^{2+}$ ion concentration of the etch solution may vary from 80 to 170 g/l. The highest etch rate desirable for the manufacture of fine conductors is obtained at a concentration of 95 g/l $Cu^{2+}$. The concentration of the etch solution is then kept constant at ±1 g/l.

The $Cu^{1+}$ ion concentration should range from 4 to 6 g/l. Although it would be easier to oxidize the etch solution completely, i.e., $[Cu^{1+}]=0$, it is desirable to have a small proportion of copper(I) ions in the etch solution, because monovalent copper acts as "edge protection". This means that the sidewalls of the conductors etched out of the copper are coated with a protective, gel type film preventing a heavy underetching of the conductors. It has been found that circuit boards with finest lines (see inter alia DE-C No. 18 07 414) can only be produced by means of copper chloride etch solutions poor in HCl which are not completely regenerated.

The content of 32 percent hydrochloric acid may vary from 8 to 20 ml per liter of etch solution. It is pointed out once again that prior art etch solutions contain 200 ml/l and more of concentrated hydrochloric acid. As previously mentioned, the high sodium chloride content of the etch solutions used according to the invention permits larger quantities of $Cu^{1+}$ to be kept dissolved in complex form, so that the etch results yielded by copper(II) chloride etch solutions with a content of up to 20 g/l $Cu^{1+}$ are still satisfactory.

For regenerating the above-described etch solutions when they become enriched with copper(II) chloride, hydrogen peroxide and hydrochloric acid are used according to the invention. Theoretically computed, for regenerating 1 kg of copper, 1.36 l of 35 percent hydrogen peroxide, 3.1 l of 32 percent HCL, 2.4 kg of sodium chloride (salt basket principle), and 2.15 kg of sodium chloride (salt tank principle) are required. On the basis of these quantities, the dosing ratio of $H_2O_2$:$H_2O$:HCl is 1:4.2:2.3.

It should be taken into account, however, that these values are theoretically computed ones and that there are losses caused by sucking off and the side reaction $$4\ CuCl + 4\ HCl + \underset{(air)}{O_2} \rightarrow 4\ CuCl_2 + H_2O.$$

Therefore, the practical values for dosing must be determined when the system is put into operation. During operation, only the addition of the oxidizing agent is controlled by means of a redox electrode, while hydrochloric acid and water enter from the dosing tanks in computed quantities.

FIGS. 3 and 4 show the regeneration units for implementing the process according to the invention. According to FIG. 3, an etch system 1 is connected to a regeneration unit 2. The storage tanks 9, 10 and 11 are provided for hydrogen peroxide, hydrochloric acid and water. The etch solution to be regenerated is fed to the oxidation reactor 12. According to FIG. 3, the lines extend from the storage tanks 9, 10 and 11 to the oxidation reactor 12. Through a control means 5, a redox electrode (sensor) 4 controls the opening of the solenoid valve 6 as a function of the measured potential, so that the accurately required quantity of hydrogen peroxide flows into the etch solution to be regenerated. The control means 5 also serves to activate the solenoid valves 7 and 8, so that hydrochloric acid and water flow in computed quantities from the dosing tank 10 and 11 to the oxidation reactor 12. In lieu of the solenoid valves, pumps may also be used for dosing. In the regeneration unit 2, a salt basket 3*a* is arranged which always contains solid sodium chloride. The etch solution flows at a constant speed through the measuring cell (sensor) 4. Pump 13 ensures that the regenerated etchant is fed back to the etch system. Excessive etch solution that is continually formed in the etch and regeneration process flows through an overflow into the overflow tank 14.

According to FIG. 4, a closed salt tank 3*b* is provided for in lieu of the open salt basket in the regeneration unit 2. The water, instead of being applied from the storage tank 11 to the oxidation reactor 12, is added to the salt tank 3*b* directly. Salt tank 3*b* comprises an overflow to the regeneration unit 2.

For controlling the addition of chemicals to the etch solution to be regenerated, i.e., for maintaining the above-described favorable concentrations of the chemicals, a redox electrode is used, by means of which this can be done with great accuracy. The redox potential occurring between the half element Au, $Cu^{2+}/Cu^{+}$ and a reference electrode, e.g., a calomel electrode, is measured. This potential depends on the concentration ratio (activity ratio) $Cu^{2+}$: $Cu^{+}$, not measuring pure redox potentials but a mixed potential which also depends on the sodium chloride content of the etch solution and and the rate V at which the etch solution flows through the sensor.

The Nernst equation for controlling the potential then reads as follows in a simplified form:

$$\epsilon = E_o + \frac{R\,T}{F} \ln \frac{a_{Cu^{2+}}}{a_{Cu^{+}}} + f\{([NaCl])\} + f(V)$$

wherein $\epsilon$ is the redox potential;

$E_o$ is the standard potential of the electrode;

R is the gas constant (8.314 voltcoulombs);

F is the Faraday charge (96493 C);

T is the absolute temperature in °K;

z is the number of the charges;

a is the activity of the ions in qUeestion (according to Lewis); and f is a symbol denoting "function of".

If the temperature, the sodium chloride content and V are kept constant, the redox potential only depends on $Cu^{2+}$ and $Cu^{+}$:

$$\epsilon = f(Cu^{2+}:Cu^{+})$$

The constant flow rate through the measuring cell is obtained by a small quantity of the etch solution from the regeneration unit 2 continuously circulating in a secondary cycle through the measuring cell (sensor 4) which is preceded by a reduction valve and a flow meter (not shown). The sodium chloride concentration is kept constant by using either a sodium chloride saturated solution or a solution whose concentration, although being below saturation, is constant. A sodium chloride saturated etch solution is obtained by providing the regeneration unit 2 with a salt basket 3*a* which always contains solid sodium chloride (FIG. 3). Before becoming saturated, the etch solution flowing through the salt basket absorbs about 4 mol/l of sodium chloride which corresponds to a quantity of 234 g/l of sodium chloride.

In a further advantageous embodiment of the invention a salt tank, whose contents are separated from the regeneration unit 2, is used to adjust and maintain a constant sodium chloride concentration. At the base of the closed salt tank 3*b* (FIG. 4) there is solid sodium chloride. For adjusting the desired concentration of sodium chloride in the etch solution, this embodiment provides for the water from the storage tank 11 to be added to the salt tank 3*b* instead of being directly added to the regeneration unit, as in the case of the salt basket principle. Through an overflow, the saturated sodium chloride solution is fed to the regeneration unit 2 (FIG. 4). According to this principle, it is also possible to adjust a constant sodium chloride concentration in the etch solution. This concentration is about 3.6 mol/l of sodium chloride which corresponds to 212 g/l of sodium chloride and thus is slightly less than that of a saturated sodium chloride solution. As a result, the etch rate decreases only slightly. This embodiment has the advantage that when the system is, for example, at a temporary standstill no sodium chloride crystallizes in the lines, as might happen with saturated sodium chloride. Through a heat exchanger (not shown), the temperature of the regeneration unit is kept constant at a value ranging from 45° to 55° C. and with an accuracy of ±1° C.

If, as previously described, the sodium chloride concentration, the flow rate V through the measuring cell (sensor 4) and the temperature are kept constant, the redox potential only depends on the ratio $Cu^{2+}$:$Cu^{+}$. The potential of the electrode assumes a positive value if the concentration of $Cu^{2+}$ rises and reaches a maximum value if the concentration of the copper(I) ions is 0. It is, however, desirable for the copper(I) ions not to be completely oxidized to copper(II) ions, because monovalent copper prevents an underetching of the conductors by edge protection and thus permits etching much finer conductor patterns. It has also been found that the change of the redox potential in the range of low copper(I) ion concentrations is much greater than at high concentrations. At between 2 and 5 g/l $Cu^{1+}$, the potential difference always amounts to, say, 26.5 mV. Therefore, it is advantageous to control the composition of the bath in that range with the aid of the redox potential. As the value of the potential difference of 26.5 mV changes according to the copper(II) ion concentration and the temperature, the latter has to be kept within a very narrow range to accurately control the oxidation of $Cu^{+}$ to $Cu^{2+}$.

In practice, the amplified potential difference is displayed on a measuring instrument and recorded. The measuring instrument is provided with a sensor which is passed by the pointer of the measuring instrument according to the potential difference in the etch solution. During this process, the solenoid valve is opened or the dosing pump is actuated in order to add hydrogen peroxide from a storage tank to the oxidation reactor above the regeneration unit. Hydrochloric acid and water are added in computed quantities.

The process of the invention permits copper chloride etch solutions that have become exhausted to be regenerated on a large technical scale. For this purpose, hydrogen peroxide and hydrochloric acid are used in a known manner. The etch solutions contain, however, much less hydrochloric acid than previously known etch solutions. In actual fact, hydrochloric acid is added only in a quantity as is stoichiometrically required for converting hydrogen peroxide to hypochlorous acid. The activity of the etch bath is considerably increased by the addition of sodium chloride.

The present invention has been disclosed in the above teachings and in the accompanying drawings and with sufficient clarity and conciseness to enable one skilled in the art to make and use the invention, to know the best mode for carrying out the invention and to distinguish it from other inventions and from what is old. Many variations and obvious adaptations of the inventions will readily come to mind and these are intended to be contained within the scope of the invention as claimed below.

What is claimed is:

1. A process for regenerating an aqueous copper chloride etch solution form a separate etch unit which, in a depleted state, includes more than about 6 g/l $Cu^{+}$ ions as copper (I) chloride, a reduced amount of copper (II) ions as copper (II) chloride, less than about 30 ml/l 32 percent HCl and sodium chloride comprising:

(i) converting a quantity of $H_2O_2$ corresponding to the copper (I) ion concentration in the solution in its depleted state into HClO by combining the $H_2O_2$ in a separate oxidation reactor with a stoichiometric quantity of HCl;

(ii) immediately thereafter in the oxidation reactor allowing the HClO to combine with the solution in its depleted state to accomplish oxidation of copper (I) chloride to copper (II) chloride by the HClO to provide a regenerated solution; and (iii) transferring the regenerated solution to a separate regeneration unit in sufficient quantity that the $CU^{+}$ ion concentration of the solution in the regeneration unit is decreased to less than about 6 g/l.

2. The process of claim 1 wherein water is added to the regenerated solution in computed quantities to adjust the concentration of copper (II) ions therein.

3. The process of claim 2 wherein the water is added to the regenerated solution in the regeneration unit.

4. The process of claim 2 wherein the water is added to the regenerated solution in the oxidation unit.

5. The process of claim 2 wherein the solution in the regeneration unit comprises about 1.5 mol/l $CuCl_2$ $2H_2O$; from about 4 to about 6 g/l copper (I) ions; from about 3.5 to about 4 mol/l NaCl and from about 8 to about 20 ml/l 32 percent HCl.

6. Thee process of claim 1 wherein the concentration of $Cu^{+}$ ions in the solution is determined by its redox potential and wherein HCl is added to the oxidation unit in computed quantities based on the quantities of $H_2O_2$ added.

7. The process of claim 6 wherein the addition of $H_2O_2$ to the oxidation unit is controlled such that the copper (I) ion concentration in the regeneration unit is kept between 4 and 6 g/l.

8. The process of claim 1 wherein the HCl concentration of said solution is kept between 8 and 20 ml/l of 32 percent HCl.

9. The process of claim 8 wherein the HCl concentration is kept between 8 and 10 ml/l of 32 percent HCl.

10. The process of claim 1 wherein the NaCl is maintained at a concentration in the solution of about 3.6 mol/l.

11. The process of claim 10 wherein the concentration of NaCl is maintained by adding water to solid NaCl in a salt tank separate from the regeneration unit such that water saturated with NaCl reaches the regeneration unit through an overflow from the separate salt tank.

12. The process of claim 1 wherein the temperature of the solution is maintained at between about 45° and 55° C.

13. A regeneration system for implementing the process according to claim 1 comprising storage tanks for hydrogen peroxide, hydrochloric acid and water, a redox electrode for controlling the addition of hydrogen peroxide responsive to the concentration of $Cu^{+}$ ions in the solution, solenoid valves or dosing pumps for adding computed quantities of hydrochloric acid and water, wherein the storage tanks are connected through connecting lines and solenoid valves or dosing pumps to an oxidation reactor receiving the solution to be regenerated from the separate etch unit, and wherein the oxidation reactor is connected to a regeneration unit which includes a connecting line with a pump back to an etch unit and an overflow to an overflow tank.

14. The ystem according to claim 13, wherein the regeneration unit includes an open salt basket for receiving solid sodium chloride.

15. The system according to claim 13, wherein a salt tank is positioned adjacent to the regeneration unit for receiving solid sodium chloride, and wherein, a line to the salt tank and an overflow from said tank to the regeneration unit are provided for adding computed quantities of water.

16. The system according to claim 13 wherein in the oxidation reactor an internal tube is provided for passing the solution to be regenerated, and the supply lines for $H_2O_2$ and HCl merge in said tube, and said tube terminates below the reaction range of $H_2O_2$ and HCl.

* * * * *